US007644561B2

(12) United States Patent
Hatchell et al.

(10) Patent No.: US 7,644,561 B2
(45) Date of Patent: Jan. 12, 2010

(54) APPARATUS FOR EXTRACTING AIR FROM PACKAGES

(76) Inventors: Peter Hatchell, 1415 Fortune Ave., DePere, WI (US) 54115; Glenn Hayes, 1415 Fortune Ave., DePere, WI (US) 54115; Ronald Hutjens, 1415 Fortune Ave., DePere, WI (US) 54115

( * ) Notice: Subject to any disclaimer, the term of this patent is extended or adjusted under 35 U.S.C. 154(b) by 0 days.

(21) Appl. No.: 12/006,958

(22) Filed: Jan. 8, 2008

(65) Prior Publication Data

US 2008/0104931 A1 May 8, 2008

Related U.S. Application Data

(63) Continuation of application No. 11/400,986, filed on Apr. 10, 2006, now Pat. No. 7,316,102.

(51) Int. Cl.
*B65B 31/04* (2006.01)

(52) U.S. Cl. ..... 53/434; 53/512

(58) Field of Classification Search ..... 53/412, 53/432, 434, 510, 512, 133.4, 139.2
See application file for complete search history.

(56) References Cited

U.S. PATENT DOCUMENTS

| | | | | |
|---|---|---|---|---|
| 2,277,288 | A | 3/1942 | Berch | |
| 2,281,187 | A | 4/1942 | Waters | |
| 2,410,834 | A | 11/1946 | Messmer | |
| 2,863,266 | A | 12/1958 | Moore | |
| 3,430,414 | A | 3/1969 | Ludwig et al. | |
| 3,708,952 | A | 1/1973 | Schulze et al. | |
| 4,016,705 | A | 4/1977 | Wilson et al. | |
| 4,418,512 | A | 12/1983 | Johnson | |
| 4,510,733 | A | 4/1985 | Hansen et al. | |
| 5,097,648 | A | 3/1992 | Berner et al. | |
| 5,501,525 | A | 3/1996 | Cox et al. | |
| 6,199,350 | B1 | 3/2001 | Brechel et al. | |
| 6,279,298 | B1 * | 8/2001 | Thomas et al. | 53/412 |
| 7,316,102 | B2 * | 1/2008 | Hatchell et al. | 53/434 |

* cited by examiner

*Primary Examiner*—Louis K Huynh
(74) *Attorney, Agent, or Firm*—Wood, Phillips, Katz, Clark & Mortimer

(57) ABSTRACT

An apparatus for extracting air from within flexible packages having granular or otherwise flowable contents includes a package conveyor and a downwardly-open, vacuum extraction hood through which the packages are conveyed so that an upper portion of each package is moved through the extraction hood. The interior of the hood is joined in fluid communication with a vacuum source, so that air is extracted from within each package as it is conveyed through the hood. The present apparatus further includes a closing mechanism positioned immediately downstream of and in operative association with the extraction hood, whereby the upper portion of each package is maintained in a closed configuration prior to sealing, so that the interior of each package is not exposed to ambient conditions after it is conveyed out of the extraction hood, and prior to sealing of the upper portion.

7 Claims, 3 Drawing Sheets

APPARATUS FOR EXTRACTING AIR FROM PACKAGES

CROSS-REFERENCE TO RELATED APPLICATION

The present application is a continuation of U.S. patent application Ser. No. 11/400,986, filed Apr. 10, 2006, now U.S. Pat. No. 7,316,102.

TECHNICAL FIELD

The present invention relates generally to packaging of granular materials and like flowable products, and more particularly to an apparatus for extracting air from flexible packages containing granular or flowable material prior to sealing of the packages.

BACKGROUND OF THE INVENTION

A wide variety of granular or otherwise flowable products, such as pet food, bird seed, cat litter, and the like, are typically packaged in upstanding, flexible package structures, typically including opposing front and rear panels, and optionally including generally inwardly extending side gussets respectively extending between the front and rear panels of the package. Such packages are provided in a bag-like configuration by closing the bottom of the package, with packages sequentially presented to a filling apparatus while in a generally upright orientation, whereby the desired quantity of contents is deposited, typically by gravity, into each package.

After filling, each package is typically positioned on an associated conveyor for movement to an associated sealing apparatus, whereby the upper portion of the bag-like package is sealed to secure the package's contents. Subsequent to filling, it can be desirable to "condition" each package, that is, position each package between a pair of vertically oriented, generally confronting conditioning conveyor belts, which respectively engage the front and rear panels of each package to "square" each package by urging the front and rear panels of each package into generally parallel relationship, in opposition to the flowable contents of each package, which tend to move downwardly under the influence of gravity. Squaring of each package in this fashion promotes package uniformity, and desirably facilitates subsequent stacking, palletizing, and like handling of the packages as they are assembled for subsequent storage and shipment.

Attendant to package conditioning, air within the package can be expelled through the open top thereof, with some air inevitably entering each package as each package is moved from the conditioning apparatus to an associated sealing apparatus. However, as will be appreciated, any air which enters each package can undesirably detract from its "square" conditioned configuration, and can also undesirably increase the internal volume in the package, prior to sealing, thus undesirably increasing the bulk of each package after sealing.

Accordingly, it is desirable to extract air from within each package, subsequent to conditioning, but prior to sealing, to facilitate maintaining each package in the desired squared, conditioned configuration, while at the same time desirably acting to minimize the bulk or size of each package subsequent to sealing.

SUMMARY OF THE INVENTION

In accordance with the present invention, an apparatus for extracting air from a series of packages prior to sealing comprises a package conveyor, and a downwardly-open, vacuum extraction hood through which the packages are conveyed.

By this arrangement, air is withdrawn and extracted from each package as each package is moved through the extraction hood. The present apparatus further includes a closing mechanism for engaging and closing the upper portion of each package before it is moved out of the extraction hood, thereby maintaining each package in an at least partially evacuated condition as each package is further conveyed to an associated sealing apparatus.

In accordance with the illustrated embodiment, the downwardly open, vacuum extraction hood of the present apparatus is connected in fluid communication with a vacuum source to extract air from within each package as it is conveyed through the extraction hood. A pair of guide rails are preferably provided which extend above the package conveyor so that the upper portion of each package is received between the guide rails as each package is conveyed into the extraction hood.

In the preferred form, the extraction hood includes a pair of internal guide baffles between which the upper portion of each package is moved while being conveyed through the extraction hood by the product conveyor. Notably, the guide baffles are configured so as to be positioned between the upper portions of the packages and associated vacuum ports of the extraction hood to thereby prevent the upper portion of each package from being drawn into, or otherwise interfering with the vacuum ports.

As will be appreciated, the closing mechanism of the present apparatus must maintain the upper portion of each package in a substantially closed condition to maintain the desired evacuated condition of each package prior to sealing. To this end, the closing mechanism comprises a pair of cooperating belts which are spring-biased toward each other for engaging and urging the upper portion of each package to a closed condition as each package is conveyed from the extraction hood. Operation of the spring-biased belts for synchronous movement with the package conveyor ensures the integrity of each package as each package is moved to the associated sealing device for sealing the upper portion thereof.

Notably, the internal baffles of the extraction hood desirably provide a registration-like effect for those packages having certain features, such as a slider zipper member, provided at the upper portion of the package. In particular, it is contemplated that such a feature can engage the upper edge of one or both of the internal baffles during movement through the extraction hood thereby facilitating the correct orientation of the upper portion of each package, and a slider zipper mechanism or the like, prior to closing of the package by the closing mechanism, and eventual sealing.

Other features and advantages of the present invention will become readily apparent from the following detailed description, the accompanying drawings, and the appended claims.

DETAILED DESCRIPTION

Figure 1:
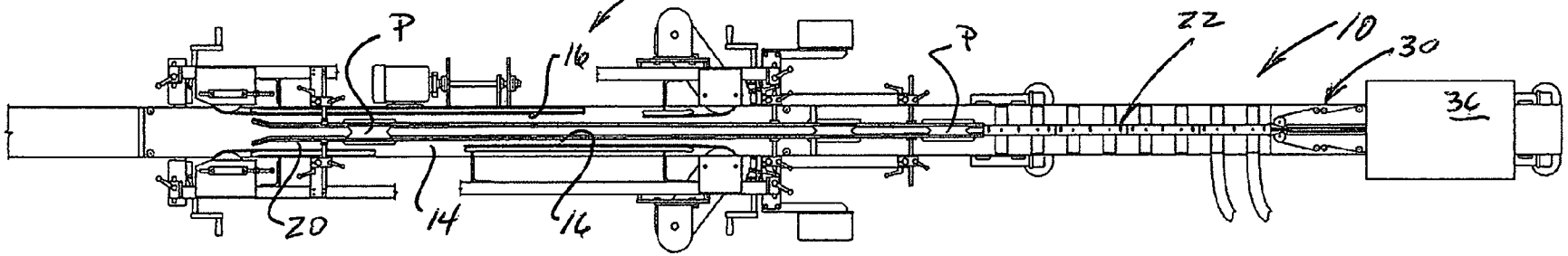
FIG. 1 is a top plan view of a packaging line including a vacuum extraction apparatus embodying the principles of the present invention.

While the present invention is susceptible of embodiment in various forms, there is shown in the drawings, and will hereinafter be described, a presently preferred embodiment, with the understanding that the present disclosure is to be considered as an exemplification of the invention, and is not intended to limit the invention to the specific embodiment illustrated.

Figure 2:
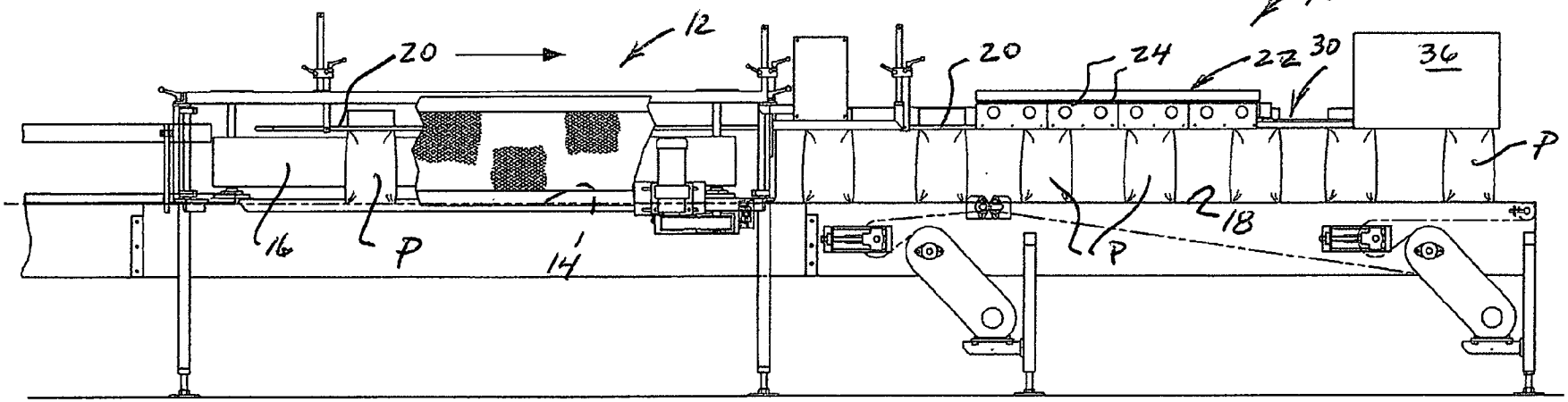
FIG. 2 is a side elevational view of the packaging line illustrated in FIG. 1.
Figure 3:
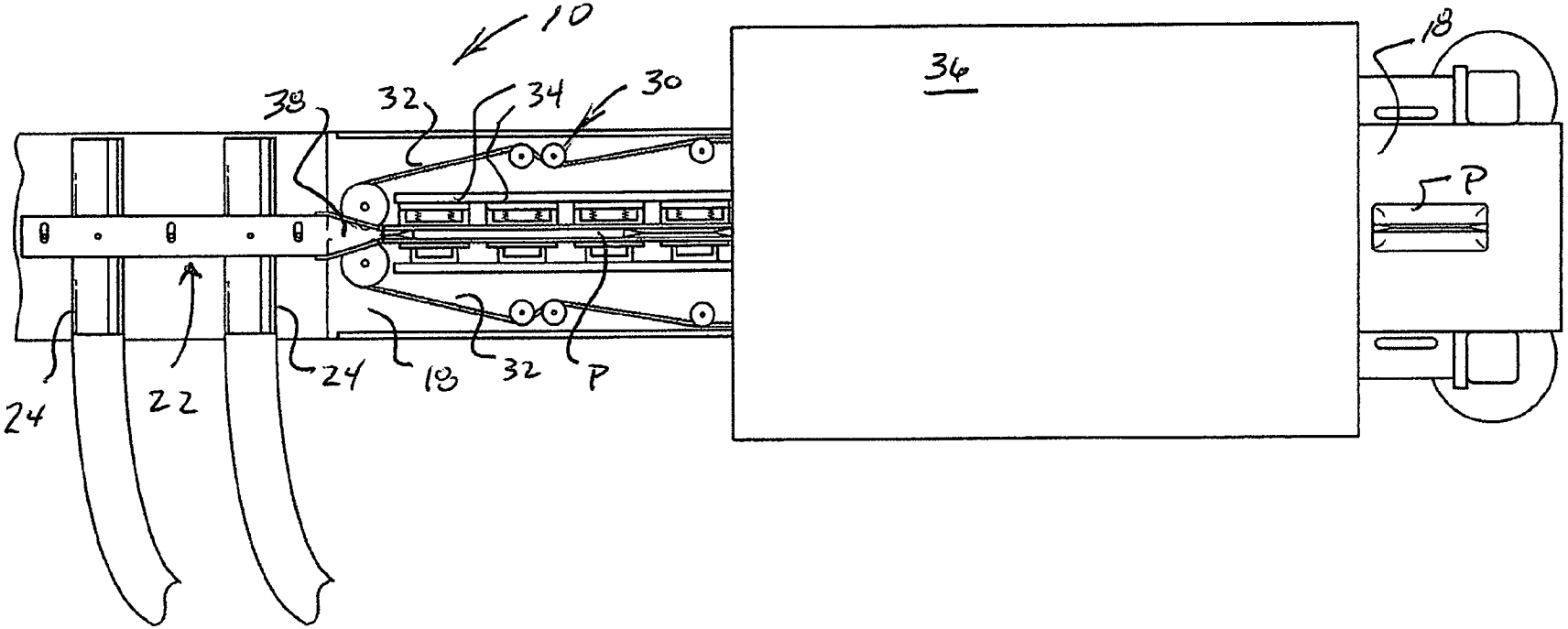
FIG. 3 is a top plan view of the vacuum extraction apparatus of the present invention, and an associated sealing mechanism.

With reference first to FIGS. 1 and 2, therein is illustrated a packaging line by which packages P, having granulated or otherwise flowable material therein, are "conditioned" and subsequently closed and sealed for eventual bundling, boxing, palletizing, or the like, and storage and shipment. In accordance with the present invention, the packaging line includes a vacuum extraction apparatus 10 embodying the principles of the present invention. As will be further described, extraction apparatus 10 acts to extract air from each package P prior to sealing of an upper portion of the package whereby each package is at least partially evacuated prior to sealing. In this fashion, each package is desirably reduced in bulk, facilitating efficient subsequent handling, with the desired extraction of air further desirably acting to generally "square" each package to a generally rectangular cross-sectional configuration thus further facilitating subsequent handling, packaging, storage, and shipment. Additionally, evacuating each package can desirably enhance the shelf life and/or quality of the package contents by reducing the amount of oxygen in the package.

In the illustrated embodiment, each package P is illustrated as including generally parallel front and rear panel portions. In a package wherein the front and rear panel portions are joined along their side edges to each other, such a package is sometimes referred to as a "pillow pack", or a "Doy Pack" where the package is provided with a stand-up pouch configuration. In contrast, the packages P may be configured as so-called side-gusseted packages, wherein each package includes a pair of side gussets which each extend between respective edges of the front and rear panels of each package. It is within the purview of the present invention that packages having a wide variety of specific configurations can be efficiently processed by the present apparatus.

With further reference to FIGS. 1 and 2, the upstream section of the illustrated packaging line includes a conditioning section 12, at which packages P may be optionally "conditioned" prior to the packages being directed through the vacuum extraction apparatus 10 of the present invention. The conditioning section 12 includes a package conveyor 14 by which each filled package P is conveyed from an upstream, associated filling apparatus (not shown). Conditioning of each package P is effected by directing each package between a pair of vertically oriented, generally confronting conditioning conveyor belts 16 which respectively engage the front and rear panels of each package, to thereby "square" each package by urging the front and rear panels thereof into generally parallel relationship with each other.

Thus, the conditioning conveying belts 16 act in opposition to the flowable contents within each package, which typically generally cause each package to bulge outwardly, detracting from the "square" orientation which is desired for each package to facilitate efficient handling and shipment. The conditioning conveyor belts 16 are preferably operated for synchronous movement with package conveyor 14. As will be appreciated, during package conditioning, each package is retained in a generally upright orientation, with the upper portion of each package open and unsealed. Conditioning of packages in this fashion is particularly desirably when the packages are side-gusseted, with the conditioning desirably acting to "square" each package, promoting package uniformity for subsequent handling. Additionally, conditioning belts 16 can be configured to vibrate rapidly vertically (via a mechanical oscillating module that rapidly hits the bottom of the conveyor belt), with the vibratory motion desirably allowing product within each package to reposition itself, into a more desirable shape as determined by the conditioning belts.

In the illustrated packaging line, the vacuum extraction apparatus 10 embodying the principles of the present invention is positioned immediately downstream of conditioning section 12. As noted, the vacuum extraction apparatus desirably acts to at least partially evacuate each of the packages P, desirably acting to reduce the bulk of each package, and promoting close conformance of the package itself with the associated contents to facilitate efficient handling. Again, package uniformity is promoted.

As the series of packages P are moved from the conditioning section 12, they are received on package conveyor 18 of the vacuum extraction apparatus. Conveyor 18 may be operated for synchronous movement with the packaging conveyor 14 of the conditioning section 12. As the packages P are moved by package conveyor 18, the upper portion of each package is preferably positioned between a pair of guide rails 20, which extend above the package conveyor. Guide rails 20 are preferably configured to converge generally toward each other, whereby the upper portion of each package P is received therebetween, with the front and rear panels of each package urged toward each other as they are moved by the package conveyor 18.

In the illustrated embodiment, guide rails 20 extend through the conditioning section 12, and are positioned above or between the conditioning belts 16. By this arrangement, the guides 20 can desirably act to move the side gussets of each package inwardly as the packages are being conveyed, and can also desirably act to shape the gable transition from the filled gusset area to the empty region of the package.

Figure 4:
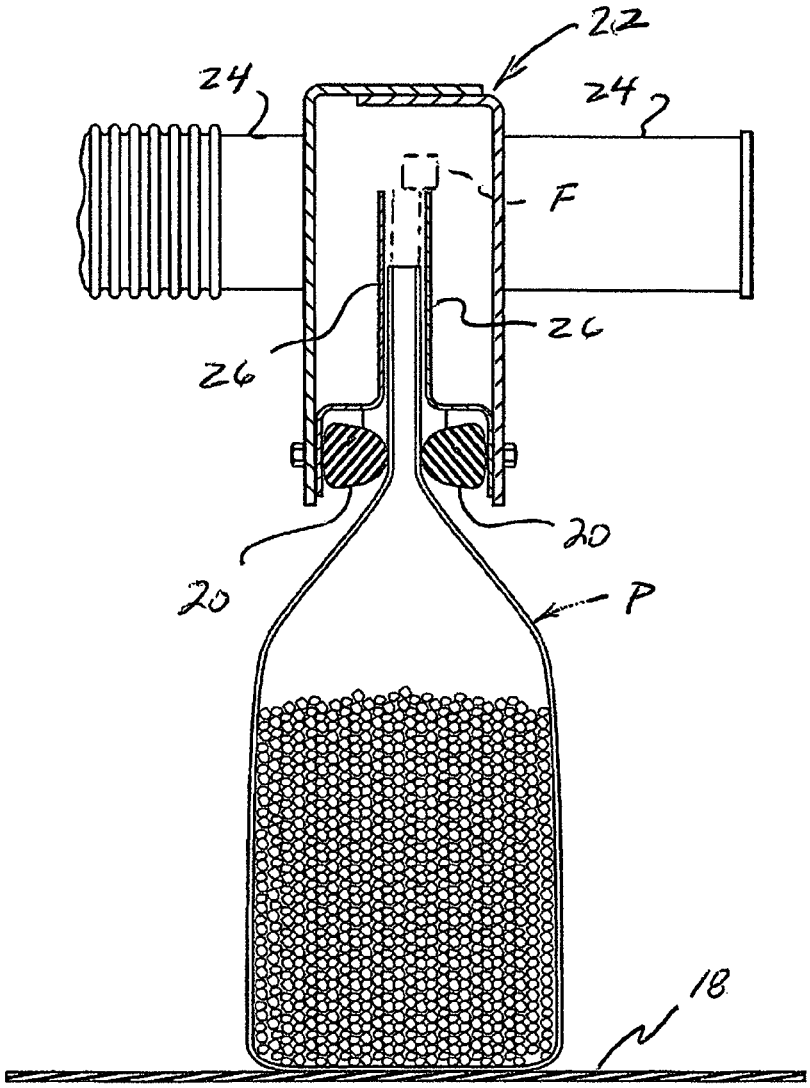
FIG. 4 is a diagrammatic, cross-sectional view taken along lines 4-4 of FIG. 3, illustrating the interior configuration of the vacuum extraction apparatus of the present invention.

To effect extraction of air from each of the packages P, the apparatus 10 includes a downwardly open, vacuum extraction hood 22 through which the packages P are conveyed by the package conveyor 18 such that the upper portion of each package is moved through the extraction hood. As best illustrated in FIG. 4, the extraction hood may be provided with a generally inverted U-shaped configuration, with the interior region of the hood 20 joined in fluid communication with a suitable source of vacuum via at least one, and preferably a plurality, of vacuum ports 24. As will be appreciated, because of the generally downwardly-open configuration of the extraction hood 22, necessary to permit the upper portion of the packages P to be conveyed therethrough, air is drawn upwardly into the hood between the guide rails 20. Thus, guide rails 20 are desirably positioned as close together as reasonably practicable, while still permitting air from within each package to be extracted through the open, unsealed upper portion thereof.

In the preferred embodiment, the extraction hood includes a pair of internal guide baffles 26 between which the upper portion of each package P is moved while being conveyed through the extraction hood by the product conveyor 18. Notably, the internal baffles 26 can desirably be configured for positioning between the upper portion of the packages P and the associated vacuum ports 24, thereby precluding an upper portion of a package from being drawn into one of the vacuum ports.

Additionally, internal baffles 26 can desirably provide a registration-like effect by engagement with a feature F of the upper portion of each package, such as the slider element of a slider zipper assembly positioned within the upper portion of each package. This engagement between the feature F of the upper portion of the package and at least one of the internal baffles, as shown in phantom line in FIG. 4, desirably acts to orient the upper portion of each package in a generally extended, upright orientation, thereby facilitating correct sealing of the upper portion, and any internal zipper assembly or the like, at the sealing section of the packaging line. Engagement with package feature in this fashion can be facilitated by configuring the internal baffles 26 to have an upwardly inclined configuration as they extend into the extraction hood 22, whereby a feature on the package can engage and "ride up" the internal baffles as the packages are conveyed along the baffles and through extraction hood 22.

As will be appreciated, because each package P is at least partially evacuated as it passes through the extraction hood 22, the upper portion of each package must be maintained in a closed condition as each package is conveyed from the extraction hood for subsequent sealing of the upper portion thereof. To this end, the extraction apparatus 10 includes a closing mechanism 30 positioned generally downstream of, and in operative association with, the extraction hood 22. Closing mechanism 30 includes a pair of cooperating, spring-biased belts 32 which are urged toward each other in generally confronting relation by a plurality of spring mechanisms 34. By this arrangement, the belts 32 present generally opposing planar surfaces which respectively engage front and rear panels of each package P as each package is moved from within extraction hood 22, and is exposed to ambient conditions. By virtue of this spring-biasing of the belts 32, the belts engage and urge the upper portion of each package to a closed condition, to thereby maintain the evacuated state of each package as each package is moved by package conveyor 18 downstream through an associated sealing apparatus 36.

In this regard, extraction hood 22 can be configured to include extension 38 by which the upper portion of each package P is exposed to the vacuum within the extraction hood until the upper portion of each package is received within the cooperating belts 32 and urged to a closed disposition. As will be appreciated, the present apparatus can be configured such that the closing mechanism 30 extends from generally within the extraction hood, with the apparatus configured such that the upper portion of each package P is not exposed to ambient conditions prior to closing and gripping of the upper portion of each package P by the closing mechanism 30. Operation of belts 32 of the closing apparatus 30 for synchronous movement with the packaging conveyor 18 assures that the upper portion of each package is tightly held in a closed condition until each package is moved into the associated sealing apparatus, and sealing of the upper portion completed. Again, as will be appreciated, the upper portion of each package is not exposed to ambient conditions, i.e., released from the belts of closing section 30, prior to formation of an air-tight seal at the upper portion of each package.

As will be appreciated by those familiar with the art, vacuum extraction in accordance with the present invention can particularly facilitate closing and sealing of certain package configurations, including side-gusseted packages having a so-called low aspect ratio, wherein the package has a relatively wide gusset relative to the height of the package. For such packages, it can sometimes be problematic to orient the side gussets in a generally inwardly extending configuration, and vacuum extraction in accordance with the present invention desirably promotes configuring the side gussets in such a fashion.

From the foregoing, it will be observed that numerous modifications and variations can be effected without departing from the true spirit and scope of the novel concept of the present invention. It is to be understood that no limitation with respect to the specific embodiment illustrated herein is intended or should be inferred. The disclosure is intended to cover, by the appended claims, all such modifications as fall within the scope of the claims.

What is claimed is:

1. A method of sealing a series of packages, wherein each said package includes a feature at an upper portion thereof, said method comprising the steps;

providing a package conveyor for conveying said packages in an upright orientation;

providing a downwardly-open vacuum extraction hood positioned above said package conveyor so that an upper portion of each said package is moved through said extraction hood, said extraction hood being connected in fluid communication with a vacuum source so that air is extracted from within each said package as it is conveyed through said extraction hood, providing a pair of guide elements extending within said vacuum extraction hood positioned above said package conveyor between which the upper portion of each said package is moved while being conveyed, so that said feature on each said package engages an upwardly facing surface of at least one of said guide elements, to thereby act to orient the upper portion in a generally upright configuration;

extracting air from within each said package as it is being moved through said vacuum extraction hood in said generally upright orientation; and closing and sealing the upper portion of each said package subsequent to said extracting step.

2. A method of sealing a series of package in accordance with claim 1, including:

providing a closing mechanism comprising a pair of cooperating belts which are spring-biased toward each other for engaging and urging the upper portion of each said package to a closed condition as each package is conveyed, said cooperating spring-biased belts being operated in synchronous movement with conveyance of said packages.

3. A method of sealing a series of packages in accordance with claim 1, including:

providing said one of said guide elements with an upwardly inclined configuration.

4. A method of sealing a series of packages in accordance with claim 1, including:

engaging an upper edge of said one of said guide elements with said feature of each said package.

5. A method of sealing packages in accordance with claim 1, wherein said feature extends generally laterally of said package.

6. A method of sealing packages in accordance with claim 1, wherein said feature comprises an element of a slider zipper assembly of each said package.

7. A method of sealing packages in accordance with claim 6, wherein said feature comprises a slider element of said slider zipper assembly of each said package.

* * * * *